US005809586A

United States Patent [19]

Kitamura

[11] Patent Number: 5,809,586

[45] Date of Patent: Sep. 22, 1998

[54] DEVICE FOR WASHING CROTCH REGION OF PATIENT

[76] Inventor: Teruo Kitamura, No.75-12, Uematsu-cho, Hamamatsu-shi, Shizuoka-ken, Japan, 430

[21] Appl. No.: 856,603

[22] Filed: May 15, 1997

[51] Int. Cl.[6] ..... A47K 3/22

[52] U.S. Cl. ..... 4/443; 4/455

[58] Field of Search ..... 4/443, 444, 446, 4/447, 450, 455, 456; 601/158; 604/257, 259, 276, 348, 354, 355; 607/86

[56] References Cited

U.S. PATENT DOCUMENTS

| | | | |
|---|---|---|---|
| 3,416,529 | 12/1968 | Weisman | 4/443 X |
| 3,678,932 | 7/1972 | Hudson | 4/444 X |

FOREIGN PATENT DOCUMENTS

| | | | |
|---|---|---|---|
| 2200033 | 7/1973 | Germany | 4/443 |
| 439806 | 9/1948 | Italy | 4/446 |
| 9-135876 | 5/1997 | Japan . | |
| 750593 | 6/1956 | United Kingdom | 4/444 |

*Primary Examiner*—Robert M. Fetsuga

*Attorney, Agent, or Firm*—Nikaido, Marmelstein, Murray & Oram LLP

[57] ABSTRACT

A device for washing the crotch region of a patient, including a base, a nozzle secured on the base for ejecting a washing liquid, a lower cushioning member provided on the base and having an opening so that the washing liquid ejected from the nozzle passes through the opening. A cover having an upper cushioning member provided with a recess portion is detachably mounted over the base with the lower cushioning member being in pressure contact with the upper cushioning member such that a washing chamber is defined by the recess, the opening and the base. The lower and upper cushioning members are shaped for supporting the femoral and lumbar regions of the patient therebetween such that the pubic region and the anal region of the patient are positioned in the washing chamber and are washed with the washing liquid ejected from the nozzle. A discharge port is provided in the base for discharging the used washing liquid from the washing chamber.

5 Claims, 8 Drawing Sheets

DEVICE FOR WASHING CROTCH REGION OF PATIENT

BACKGROUND OF THE INVENTION

This invention relates to a device for use in evacuation and urination of a patient lying on its back and, more specifically, to a device for washing the crotch regions including the pubic and anal regions of such a patient after evacuation and/or urination.

A diaper has been hitherto used for a patient lying on a bed. In replacing the diaper with a new one, the pubic and anal regions are wiped with a wet or dry paper or towel. Thus, the use of diapers has a problem because of the generation of malodor during the replacement and because of incomplete cleaning of the crotch region of the patient.

SUMMARY OF THE INVENTION

It is, therefore, the prime object of the present invention to provide a device for use in evacuation and urination of a patient lying on its back, which device can prevent the generation of malodor and can wash the pubic and anal regions of the patient.

In accomplishing the above object, there is provided in accordance with the present invention a device for washing the crotch region of a patient, which includes:

a base, nozzle means secured on the base for ejecting a washing liquid, a lower cushioning member provided on the base and having an opening so that the washing liquid ejected from the nozzle means passes through the opening, and a cover having an upper cushioning member provided with a recess portion, the cover being detachably mounted over the base with the lower cushioning member of the base being in pressure contact with the upper cushioning member of the cover such that a washing chamber is defined by the recess, the opening and the base. The lower and upper cushioning members are shaped for supporting the femoral and lumbar regions of the patient therebetween such that the pubic region and the anal region of the patient are positioned in the washing chamber and are washed with the washing liquid ejected from the nozzle means. A discharge port provided in the base for fluid communication with the washing chamber so that the washing liquid used for washing the pubic and anal regions of the patient is withdrawn from the washing chamber through the discharge port.

BRIEF DESCRIPTION OF THE DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
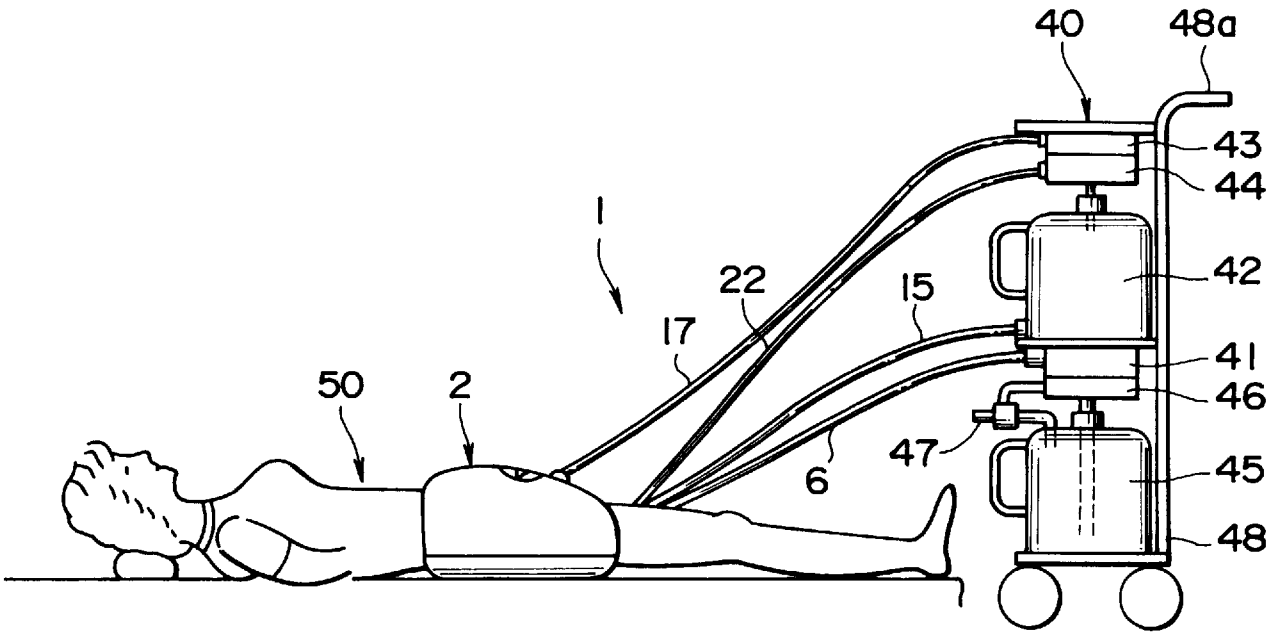
FIG. 1 is a side view schematically illustrating the state of use of a washing device according to the present invention.

FIG. 1 depicts the state of a first embodiment of a washing device 1 according to the present invention attached to a patient 50. The washing device includes a main body 2 and an auxiliary equipment section 40 connected to the main body by various pipes.

Figure 2:
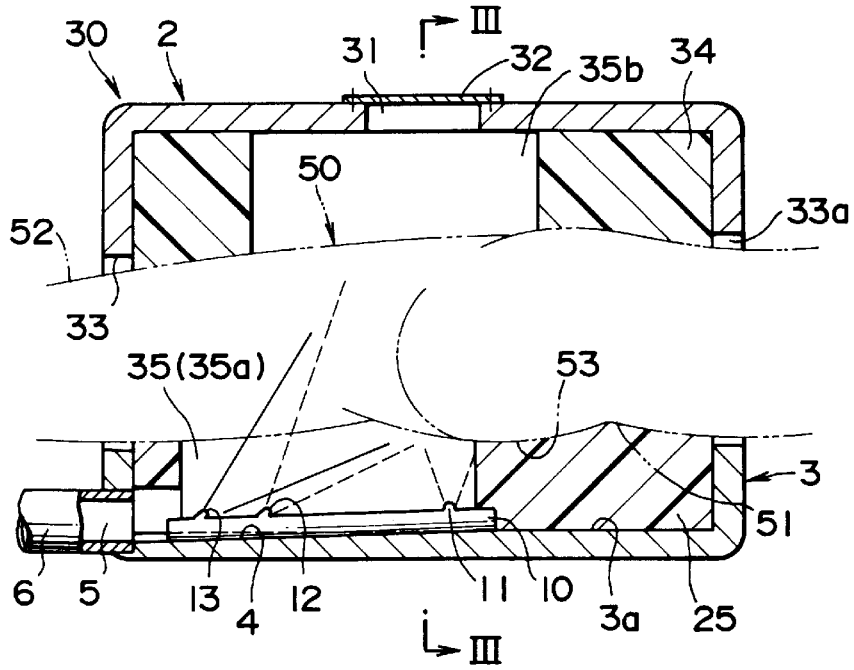
FIG. 2 is a cross-sectional side view showing an essential part of a first embodiment of a washing device according to the present invention.
Figure 3:
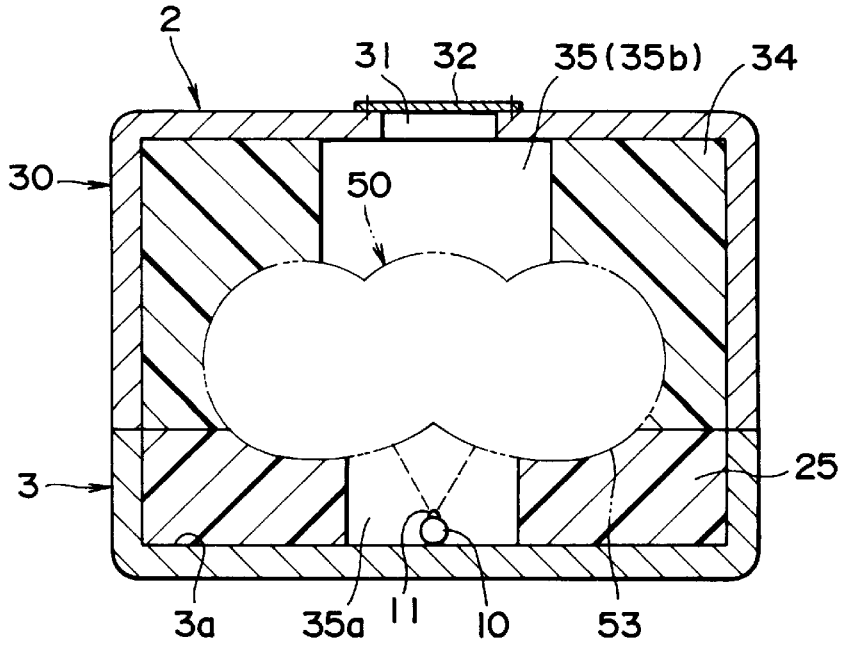
FIG. 3 is a sectional view taken on the line III—III in FIG. 2.
Figure 4:
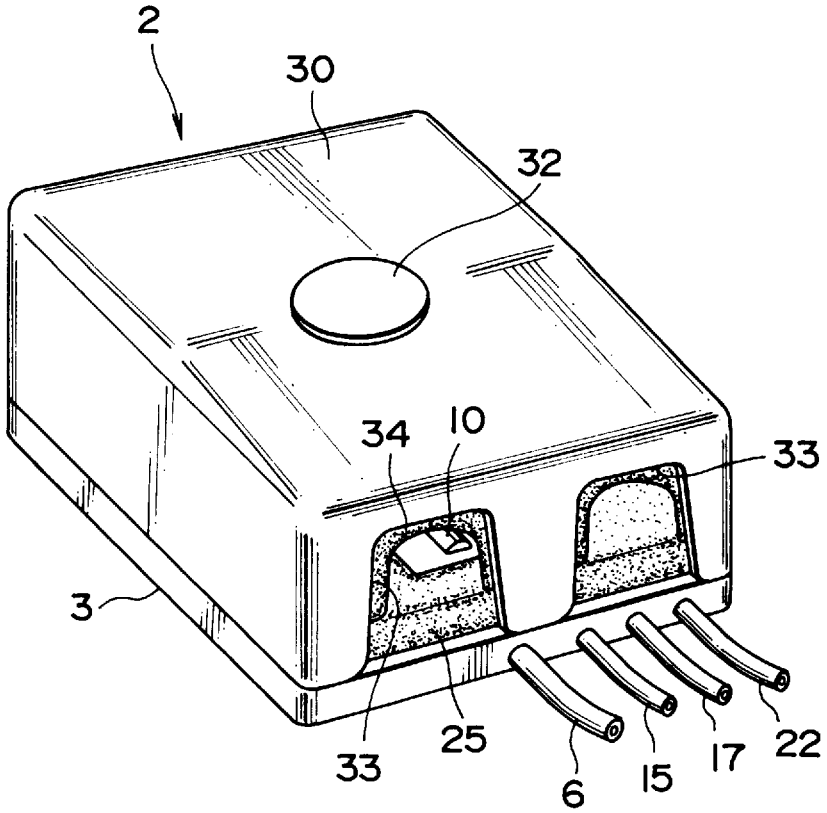
FIG. 4 is a perspective view of the essential part of the first embodiment.

As shown in FIGS. 2–5, the main body 2 has a lower base 3 and an upper cover 30 detachably mounted over the base 3. The base 3 is in the form of a shallow vessel made of, for example, a hard plastic and containing a lower cushioning member 25 having an opening 35*a*. The cover 30 is also in the form of a vessel made of, for example, a hard plastic and having an upper cushioning member 34 provided with a recess portion 35*b*. The recess portion 35*b* in the illustrated embodiment is a through hole. As best seen in FIG. 2, when the base 3 is closed with the cover 30, the upper and lower cushioning members 34 and 25 are in pressure contact with each other at marginal regions to define a washing chamber 35 therebetween by the recess portion 35*b*, the opening 35*a* and the bottom 3*a* of the base 3. The lower and upper cushioning members 25 and 34 are shaped for supporting the femoral regions 52, lumbar region 51 and gluteal regions 53 of the patient 50 therebetween such that the pubic region and the anal region of the patient are positioned in the washing chamber 35.

The bottom wall 3*a* of the base 3 is provided with a longitudinally extending concave portion 4 adjacent a front end (left end in FIG. 2) of the base 3 and just beneath the opening 35*a* of the lower cushioning member 25. The concave portion 4 has an inclined bottom 4*a* so that water in the concave portion 4 can flow by gravity toward the front end potion thereof. Provided in the front end of the base 3 is a discharge port 5 to which a flexible discharge tube 6 is connected.

A longitudinally extending injection pipe 10 is secured on the inclined bottom 4*a* of the concave portion 4. The inside space of the pipe 10 is separated by a partition into an upper water passage and a lower air passage. First and second nozzles 11 and 12 are provided in the injection pipe for communication with the upper water passage so that water or warm water is injected from the first and second nozzles 11 and 12 into the washing chamber 35 for washing the pubic and anal regions of the patient 50, respectively. An air nozzle 13 is connected to the lower air passage of the pipe 10 for injecting air or warm air and for drying the washed crotch regions of the patient 50.

Figure 6:
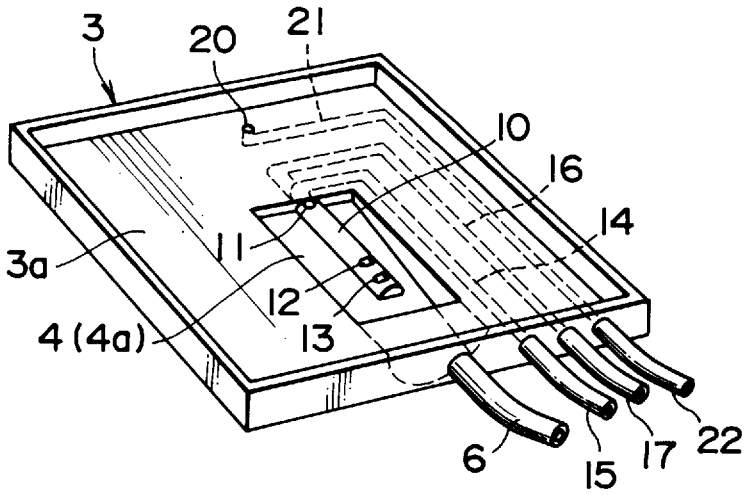
FIG. 6 is a perspective view of the base of FIG. 5 in which a cushioning material has been removed.
Figure 7:
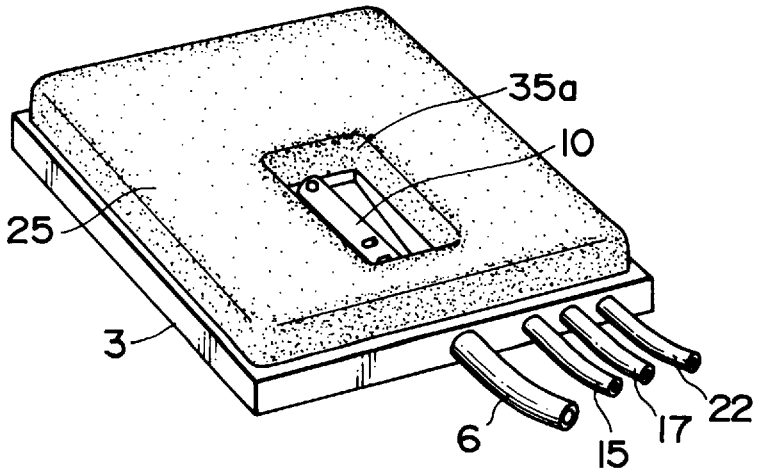
FIG. 7 is a perspective view of the base of FIG. 6 on which the cushioning material has been attached.

As shown in FIGS. 6 and 1, the water passage of the injection pipe 10 is connected to a water path 14 which is formed within the bottom wall 3*a* of the base 3 and which in turn is connected to a flexible water feed pipe 15. Also provided within the bottom wall 3*a* is an air path 16 for connecting the air passage of the injection pipe 10 and a flexible air feed pipe 17.

Figure 8:
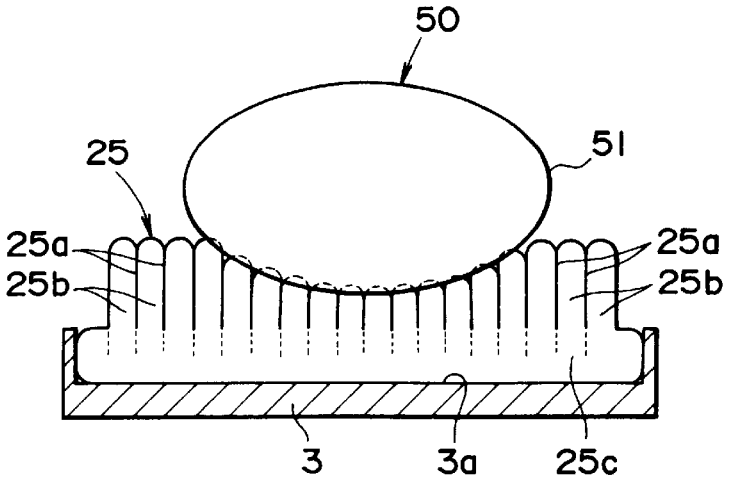
FIG. 8 is a sectional view schematically showing the state of the base supporting the lumbar region of the patient.
Figure 9:
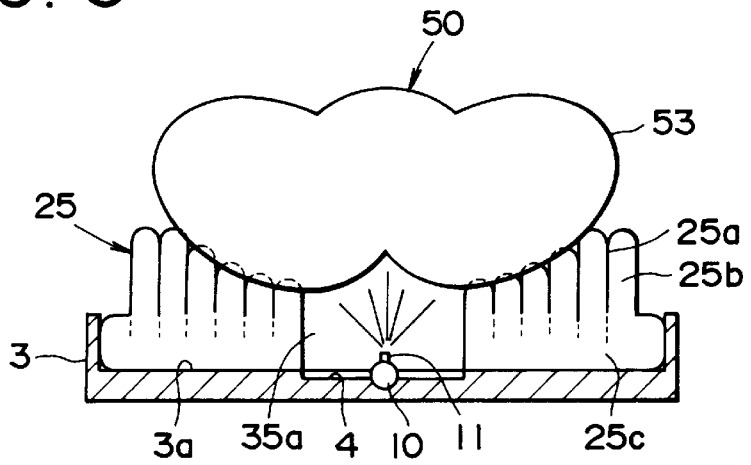
FIG. 9 is a sectional view, similar to FIG. 8, schematically showing the state of the base supporting the gluteal region of the patient.
Figure 10:
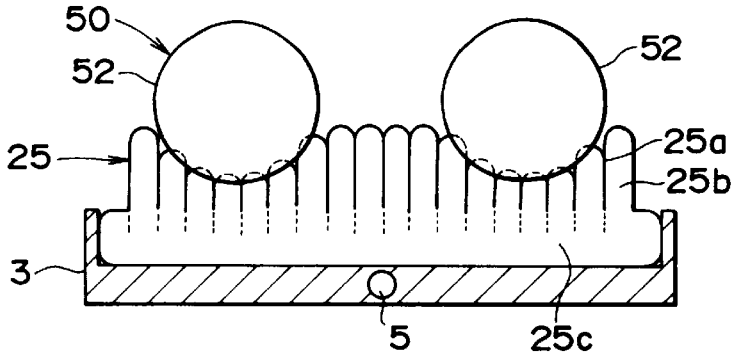
FIG. 10 is a sectional view, similar to FIG. 8, schematically showing the state of the base supporting the femoral regions of the patient.
Figure 11:
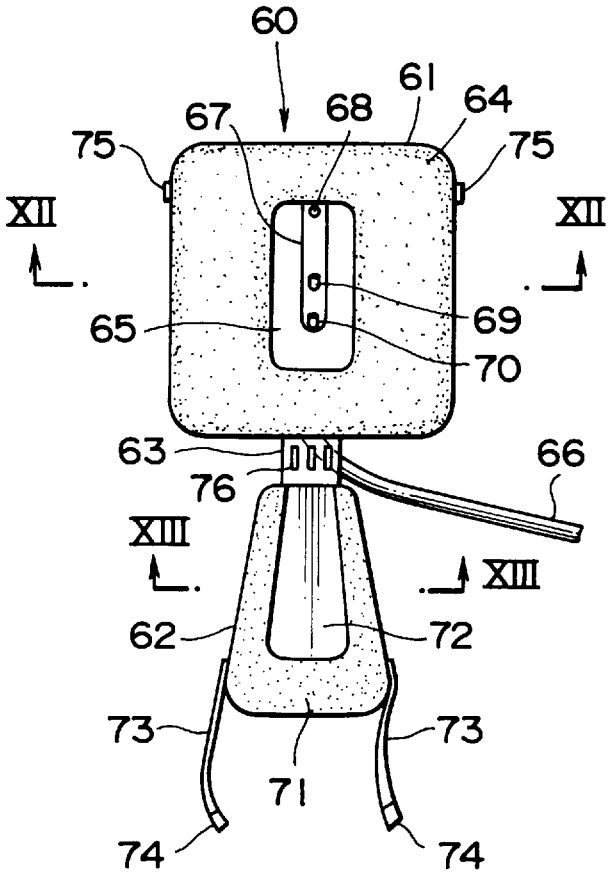
FIG. 11 is a plan view showing a second embodiment of a washing device according to the present invention.
Figure 12:
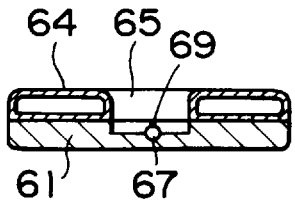
FIG. 12 is a sectional view taken on the line XII—XII in in FIG. 11.
Figure 13:
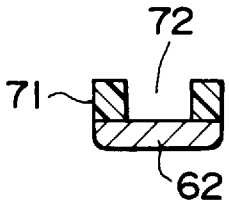
FIG. 13 is a sectional view taken on the line XIII—XIII in FIG. 11.
Figure 14:
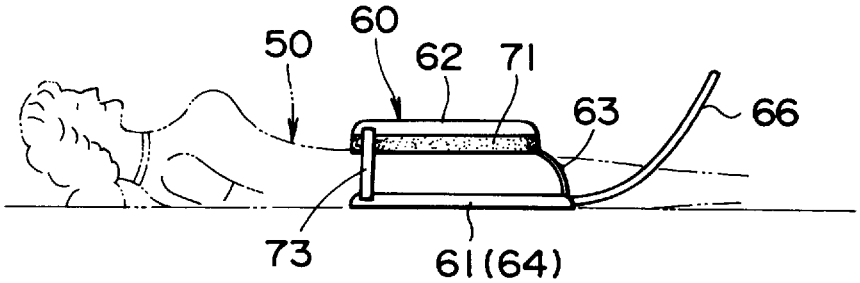
FIG. 14 is a side view of the washing device of the second embodiment showing the state in which the device is attached to a patient.

Any cushioning material such as a sponge, an air bag or a soft urethane foam may be used as the cushioning members 25 and 34. In order to prevent the cushioning members 25 and 34 from absorbing a gas and a liquid, it is desirable to cover a sponge, a foam or the like absorbing material with an impermeable film or sheet when such a material is used for the cushioning members 25 and 34. It is preferred that the lower cushioning member 25 be an air bag or tube made of a plastic such as Nylon and having a multiplicity of partition walls 25 extending vertically within the bag from the top wall and terminating at a position spaced apart from the bottom wall to define a lower common chamber 25*c* and a multiplicity of vertically extending air chambers 25*b*. The common chamber 25*c* has a port connected to an air feed port 20 provided in the bottom wall 4*a* of the base 4. The air feed port 20 is, in turn, connected to an air supply pipe 22 through an air supply path 21 formed in the bottom wall 4*a*. Thus, when an air is supplied from the air supply pipe 22, the air bag 25 is inflated so that the upper surfaces of the bag are located above the base 3. As shown in FIGS. 8–10, the upper surfaces of the bag 3 are contoured to nearly fit with the lumber portion 51, the gluteal portions 53 and the femoral portions 52, when the bag 25 is inflated. The upper cushioning member 34 may also be formed from a similar air bag.

Figure 5:
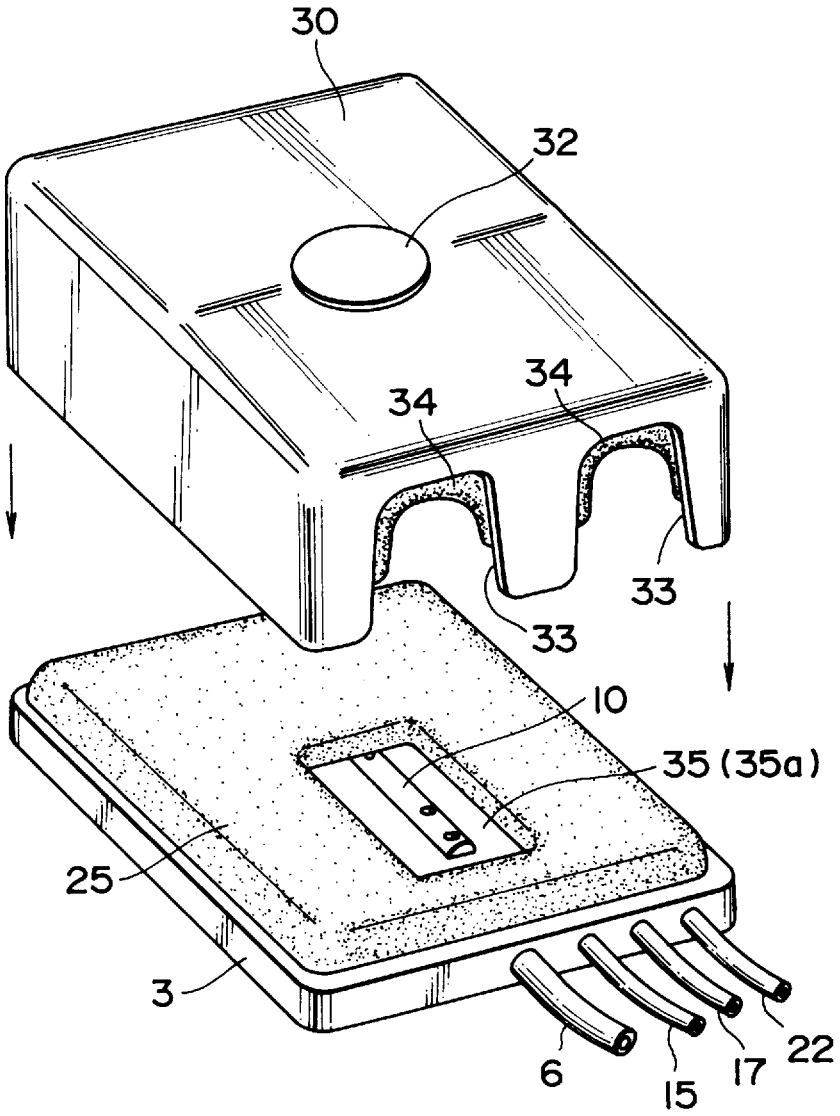
FIG. 5 is an exploded, perspective view of the first embodiment in which a cover is separated from a base.

The cover 30 is preferably provided with an aperture 31 at a position above the recess 35*b*. The aperture 31 has a diameter sufficient to insert a person's hand and arm and can be opened and closed with a lid 32. In FIG. 5, designated by reference numeral 33 is a pair of U-shaped cut away portions to receive the femoral regions 52 of the patient 50. A large U-shaped cut away portion 33*a* is also formed on the opposite side of the cover 30 (FIG. 2) to receive the trunk of the patient 50.

Referring again to FIG. 1, the auxiliary equipment section 40 has a frame 48 supported on wheels and having a pair of handles 48*a* at upper ends thereof. Supported on the frame 48 are a filthy water storage tank 45, an ozone generator 46, a suction pump 41, a warm water tank 42, an air pump 44 and a heat pump 43. The filthy water tank 45 is connected to the washing chamber 35 through the discharge tube 6 for receiving urine, feces and washing water discharged from the washing chamber 35 by the operation of the suction pump 41. An exhaust gas pipe 47 extends into the tank 45 and terminates in the space above the filthy water in the tank 45. An ozone feed pipe extends between the ozone generator 46 and the exhaust gas pipe 47 to deodorize the gas passing through the exhaust pipe 47.

To the warm water tank 42 is connected the water feed pipe 15 and is coupled with the air pump 44. By the operation of the air pump 44, the warm water in the tank 42 is pressurized so that the warm water is fed through the pipe 15 to the first and second nozzles 11 and 12. The air pump 44 is also connected to the air supply pipe 22 to inflate the cushioning member 25. The heat pump 43 is connected to the air feed pipe 17 to supply warm air to the washing chamber 35.

The above washing device 1 operates as follows.

First, the base 3 is inserted between the patient 50 and a bed on which the patient 50 lies such that the opening portion 35*a* is located under the crotch region of the patient 50. The cover 30 is then placed on the base 3 and is secured thereto by fixing means (not shown). The air pump 44 is actuated to feed air to the lower cushioning member 25 through the air supply pipe 22, air supply path 21 and air feed port 20, so that the cushioning member 25 is inflated to raise and support the lumber region 51, femoral regions 52 and gluteal region 53 of the patient 50 with the simultaneous pressure contact between the marginal portions of the upper and lower cushioning members 34 and 25 and between the cushioning members 34 and 35 and the lumber region 51, femoral regions 52 and gluteal region 53 of the patient 50, thereby to establish the airtight washing chamber 35 (see FIGS. 2 and 3) in which the pubic and anal regions of the patient are located.

After the catharsis and/or urination of the patient, the outlet of the air pump 44 is then shifted to the warm tank 42 to pressurize the inside space of the tank. Thus, the warm water is fed from the tank 42 to the injection pipe 10 through the water feed pipe 15 and the water path 14 and is injected from the first and second nozzles 11 and 12 toward the anal and pubic regions of the patient to wash the crotch regions. If necessary, the lid 32 of the cover 30 is opened to insert a hand of a person through the aperture 31 to assist the washing.

Simultaneously, the suction pump 41 is actuated to discharge the filthy water on the bottom 4*a* of the concave portion 4 of the base 3 and to introduce the filthy water to the tank 45 through the discharge tube. In this case, the ozone generator 46 is also actuated to feed ozone to the exhaust pipe 47 to deodorize the exhaust gas discharged to atmosphere from the pipe 47. After the filthy water in the concave portion 4 has been removed and the crotch regions of the patient have been cleaned, the heat pump 43 is driven to feed warm air to the injection pipe 10 through the air feed pipe 17 and the air path 16 and injected to the crotch regions of the patient to dry the washed regions.

FIGS. 11–14 illustrate another embodiment of the present invention. Designated generally as 60 is a main body of a washing device. The main body 60 includes a generally square base 61 of a hard plastic plate and a generally trapezoidal cover 62 of a hard plastic plate and rotatably connected to the base 61 by a flexible band 63. The base 61 is fixedly provided with an annular cushioning member 64, such as an air bag similar to that of the above first embodiment, defining therewithin an elongated opening portion 65. The base 61 has a concave portion (similar to the first embodiment) at a position coinciding with the elongated opening 65 of the cushioning member 64. The concave portion has a bottom surface tapered downward from the rear end to the front end (from the upper end to the lower end in FIG. 11). A discharge port (not shown) is provided in the front end and is connected to a discharge tube 66.

An injection pipe 67 extending along the longitudinal direction of the elongated opening portion 65 is secured to the bottom of the concave portion of the base 61. Similar to the first embodiment, first and second nozzles 68 and 69 and an air nozzle 70 are provided in the injection pipe 67. The first and second nozzles 68 and 69 are oriented so that water or warm water is injected toward the anal region and pubic region of the patient 50, while the air nozzle 70 is oriented to blow warm air toward the crotch region including the anal and pubic regions of the patient.

A cushioning member 71 made of a sponge, soft urethane foam or the like cushioning material covered with an impermeable film is fixedly secured to the cover 62. The cushioning member 71 is in a U-shaped form having a recess 72 which together with the opening portion 65 defines a washing chamber, when the cover 62 is mounted on the base 61. A pair of connecting bands 73 each having a face fastener 74 at an end are fixed to end portions of the cover 62. The fasteners 74 can engage with fasteners 75 when the cover 62 is placed on the base 61 to secure the cover 62 and the base 61 to each other with the patient 50 being interposed therebetween. The connecting band 63 is provided with through holes 76.

Similar to the first embodiment, a water feed pipe, an air feed pipe and an air supply pipe are connected to the base for fluid communication with the injection pipe 67 and the air bag 64 and an auxiliary equipment section in provided in association with the main body 60. These parts are substantially the same as those in the first embodiment and the detailed description thereof is omitted here.

In operation, the base 61 is disposed under the crotch region of the patient 50 such that the recess 65. The cushioning member 64 is then inflated to raise and support the lumber region, femoral regions and gluteal region of the patient 50 thereon. The cover 62 is folded at the flexible band 73 and placed on the base 61 and is secured thereto by the connecting band 73. Thus, the anal and pubic regions of the patient 50 are confined within the washing chamber defined by the opening portion 65, recess 72 and the flexible band 73 and are washed in substantially the same manner as those in the first embodiment. The through holes 76 of the flexible band 73 serve to function as an air inlet when the washing chamber is suctioned for the withdrawal of the filthy water by a suction pump (corresponding to the pump 41 in the first embodiment), so as to avoid excessive tightening and pressing of the patient 50. The second embodiment has a merit that the structure is simple and compact.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A device for washing the crotch region of a patient, comprising:

a base;

nozzle means secured on said base for ejecting a washing liquid;

a lower cushioning member provided on said base and having an opening so that the washing liquid ejected from said nozzle means passes through said opening;

a cover having an upper cushioning member provided with a recess portion, said cover being detachably mounted over said base with said lower cushioning member of said base being in pressure contact with said upper cushioning member of said cover such that a washing chamber is defined by said recess, said opening and said base;

said lower and upper cushioning members being shaped for supporting the femoral and lumbar regions of said patient therebetween such that the pubic region and the anal region of said patient are positioned in said washing chamber and are washed with the washing liquid ejected from said nozzle means; and a discharge port provided in said base for fluid communication with said washing chamber so that the washing liquid used for washing the pubic and anal regions of said patient is withdrawn from said washing chamber through said discharge port.

2. A device as claimed in claim 1, further comprising an air injection nozzle secured on said base and located in said washing chamber for injecting air toward the pubic and anal regions of said patient.

3. A device as claimed in claim 1, wherein said recess portion of said upper cushioning member is an open portion, wherein said cover is provided with an aperture to permit a person's hand to insert into said washing chamber through said aperture and said open portion, and wherein said cover has a lid for opening and closing said aperture.

4. A device as claimed in claim 1, further comprising a suction pump, and a pipe extending between said discharge port and said suction pump.

5. A device as claimed in claim 1, wherein said lower cushioning member is an air bag having a plurality of air chambers.

* * * * *